US008393433B2

(12) United States Patent
Inoue et al.

(10) Patent No.: US 8,393,433 B2
(45) Date of Patent: Mar. 12, 2013

(54) EXHAUST STRUCTURE OF MOTORCYCLE

(75) Inventors: Yosuke Inoue, Saitama (JP); Yoshinobu Tateshima, Saitama (JP); Tatsuhiko Asano, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 288 days.

(21) Appl. No.: 12/393,495

(22) Filed: Feb. 26, 2009

(65) Prior Publication Data

US 2009/0236175 A1 Sep. 24, 2009

(30) Foreign Application Priority Data

Mar. 18, 2008 (JP) ..... 2008-068752

(51) Int. Cl.
*B60K 13/04* (2006.01)

(52) U.S. Cl. ..... 180/309; 180/296; 180/89.2

(58) Field of Classification Search ..... 180/9.25, 180/296, 309, 89.2; 181/255; D12/194; 60/323, 296, 312, 299
See application file for complete search history.

(56) References Cited

U.S. PATENT DOCUMENTS 4,428,451 A * 1/1984 Yamaoka ..... 180/229
4,484,651 A * 11/1984 Hattori et al. ..... 180/225
5,183,130 A * 2/1993 Nakamura et al. ..... 180/219
6,332,505 B1 * 12/2001 Tateshima et al. ..... 180/229
6,336,321 B1 * 1/2002 Sagara et al. ..... 60/324
6,508,214 B1 * 1/2003 Uchida ..... 123/65 PE
7,637,345 B2 * 12/2009 Kurokawa et al. ..... 180/311
2008/0060864 A1 * 3/2008 Arai ..... 180/219

FOREIGN PATENT DOCUMENTS

JP 01313610 A * 12/1989
JP 2686965 B2 12/1997

* cited by examiner

*Primary Examiner* — Katy M Ebner
*Assistant Examiner* — Emma K Frick
(74) *Attorney, Agent, or Firm* — Birch, Stewart, Kolasch & Birch, LLP

(57) ABSTRACT

An exhaust pipe connected to an exhaust port of an engine and an expansion chamber is disposed in the vicinity of the engine. A main tube is provided that extends rearwardly from a head pipe disposed at the front side of a main body. An engine having a cylinder extending upwardly from a crankcase is disposed under the main tube with an exhaust port open at the front side of the cylinder. A first exhaust pipe is provided that is connected to the exhaust port. A down tube is disposed on the center line in the left-right direction of the main body. The exhaust port disposed behind the down tube is deviatingly open at one side from the center line. The first exhaust pipe extends forward from one side of the down tube, and to the other side of the down tube, subsequently turns, and extends again to one side.

15 Claims, 11 Drawing Sheets

EXHAUST STRUCTURE OF MOTORCYCLE

CROSS-REFERENCE TO RELATED APPLICATIONS

The present application claims priority under 35 USC 119 to Japanese Patent Application No. 2008-068752 filed on Mar. 18, 2008 the entire contents of which are hereby incorporated by reference.

BACKGROUND OF THE INVENTION

1. Field of the Invention

The present invention relates to an exhaust structure of a motorcycle.

2. Description of Background Art

A motorcycle is known that is equipped with a two-cycle engine in which an expansion chamber connected with an exhaust pipe is disposed in the vicinity of the engine. See, for example, JP Patent No. 2686965. As disclosed in JP Patent No. 2686965, an exhaust pipe is connected to an exhaust port of a cylinder that is open to the center in the width direction of a main body temporarily and extends to a left side of the main body and then bends to a right side.

The structure of disposing the expansion chamber as disclosed in JP Patent No. 2686965 is useful for various motorcycles. However, there are very little examples where the structure of JP Patent No. 2686965 can be applied as it is, without being limited to an opening position of the exhaust port of the cylinder at the center in a width direction of the main body as disclosed in JP Patent No. 2686965. Therefore, for example, in a motorcycle or the like having an exhaust port that is open in a position near to one side of the main body, it has been required to achieve a method for effectively attaching the exhaust pipe from an exhaust port of the engine and disposing an expansion chamber in the vicinity of the engine.

SUMMARY AND OBJECTS OF THE INVENTION

It is an object of an embodiment of the present invention to provide an exhaust structure of a motorcycle that makes it possible to dispose an expansion chamber in the vicinity of an engine by effectively attaching an exhaust pipe connected to an exhaust port of the engine.

For achieving the above-mentioned object, according to an embodiment of the present invention, there is provided an exhaust structure of a motorcycle in which a main tube extending rearward from a head pipe, disposed at a front side of a main body, is provided wherein an engine is disposed under the main tube. The engine includes a cylinder extending upwardly from a crankcase, an exhaust port is open at a front side of the cylinder, an exhaust pipe, connected to the exhaust port, is provided wherein a down tube is disposed on a center line in the left-right direction of the main body with the exhaust port being disposed behind the down tube and being deviatingly open at one side from the center line in the left-right direction of the main body. The exhaust pipe connected to the exhaust port extends forward from one side of the down tube, extends to the other side of the down tube at the front side of the down tube, subsequently turns, extends again to one side, and is connected to an expansion chamber disposed at a side of the cylinder at one side.

According to this configuration, the exhaust pipe connected to the exhaust port deviatingly open at one side from the center line of the main body extends to the other side across the center line of the main body through the front side of the down tube, subsequently turns, extends again to the side to which the exhaust port is open, and is connected the expansion chamber at the side of the cylinder at one side. That is, while a mass is concentrated by disposing the expansion chamber forming a muffler the vicinity of the engine, the exhaust pipe from the exhaust port to the expansion chamber is effectively disposed such that the exhaust pipe has a sufficient length by being disposed long to allow the engine to sufficiently exhibit its performance. Therefore, it is possible to dispose the expansion chamber in the vicinity of the engine while ensuring a sufficient length of the exhaust pipe to the expansion chamber. Further, it is possible to concentrate the mass to allow the engine to sufficiently exhibit its performance, and improve mobility of the motorcycle.

Further, since it is generally easy to ensure a space at a side of the cylinder, it is possible to easily increase the volume of the expansion chamber and effectively remove exhaust noise by disposing the expansion chamber to a side of the cylinder. Further, in this configuration, the mass in the vicinity of the engine increases, such that mass concentration can be achieved. Furthermore, when this is applied to a motorcycle having a structure wherein a muffler having another expansion chamber is connected to the lower stream of the expansion chamber, the volume of the expansion chamber increases and it is correspondingly possible to decrease the volume of a second expansion chamber of the muffler without decreasing the performance of removing noise. Therefore, it is possible to reduce the weight of the muffler disposed apart from the engine and further achieve mass concentration.

Further, according to an embodiment of the present invention, there is provided an exhaust structure of a motorcycle, in which a main tube is provided that extends rearwardly from a head pipe disposed at a front side of a main body. The engine is disposed under the main tube. The engine includes a cylinder extending upwardly from a crankcase, an exhaust port that is open at a front side of the cylinder, an exhaust pipe connected to the exhaust port is provided. A down tube is disposed on a center line in the left-right direction of the main body, the exhaust port disposed behind the down tube is deviatingly open at one side from the center line in the left-right direction of the main body with the exhaust pipe connected to the exhaust port extending forward from one side of the down tube, extending downward at the front side of the down tube, turns under the crankcase, further extends to one side, and is connected to an expansion chamber disposed at a side of the cylinder at one side.

According to this configuration, the exhaust pipe connected to the exhaust port deviatingly open at one side from the center line of the main body first extends to the front side of the down tube, extends downward in front of the down tube, reaches the lower side of the crankcase, turns at this position, further extends to the side to which the exhaust port is open, and is connected to the expansion chamber disposed at the side of the cylinder at one side. More specifically, while a mass is concentrated by disposing the expansion chamber forming a muffler in the vicinity of the engine, the exhaust pipe from the exhaust port to the expansion chamber is effectively disposed such that the exhaust pipe has a sufficient length by being disposed long to allow the engine to sufficiently exhibit its performance. Therefore, it is possible to dispose the expansion chamber in the vicinity of the engine and ensure a sufficient length of the exhaust pipe to the expansion chamber. Further, it is possible to concentrate the mass to allow the engine to sufficiently exhibit its performance, and improve mobility of the motorcycle.

Further, since it is generally easy to ensure a space at a side of the cylinder, it is possible to easily increase the volume of the expansion chamber and effectively remove exhaust noise by disposing the expansion chamber to one side of the cylinder. Further, in this case, the mass in the vicinity of the engine is concentrated, such that mass concentration can be achieved. Furthermore, when this is applied to a motorcycle having a structure wherein a muffler having another expansion chamber is connected to a lower stream of the expansion chamber, the volume of the expansion chamber increases and it is correspondingly possible to decrease the volume of a second expansion chamber of the muffler without decreasing the performance of removing noise. Therefore, it is possible to reduce the weight of the muffler disposed apart from the engine and further achieve mass concentration.

Further, in the above configuration, the inner sidewall of the expansion chamber may be inclined to be widened toward the front side, a portion of the exhaust port which extends forward from the exhaust port may be widened outwardly according as it extends toward the front side along the inner sidewall.

According to this configuration, the exhaust pipe from the exhaust port to the expansion chamber can have a sufficient length and is appropriately disposed.

Further, in the above configuration, a second exhaust pipe extending rearwardly is connected to the expansion chamber, the second exhaust pipe passes through an inner side of a pivot plate connected to the rear end of the main tube and may be connected to a second expansion chamber disposed behind the pivot plate.

In this case, it is possible to effectively remove exhaust noise by the expansion chamber and the second expansion chamber. Further, since the second exhaust pipe is disposed inside the main body frame on the inner side of the pivot plate, it is possible to prevent the second exhaust pipe from protruding in the width direction of the main body, reduce the width of the motorcycle, and protect the second exhaust pipe from outer force or the like. Furthermore, since the second exhaust pipe is hardly exposed to the outside of the main body, there is an advantage that a degree of freedom in design of the main body is increased.

Further, in the above configuration, a radiator is disposed at the other side of the down tube, the exhaust pipe bends upward at the other side of the down tube, turns at a position close to the bottom of the radiator and extends downward, and may then extend to one side in front of the crankcase.

In this case, since the exhaust pipe extending to the other side through the front side of the down tube bends upward at the other side, subsequently turns downward, and extends to one side, it is possible to ensure sufficient length of the exhaust pipe from the exhaust port to the expansion chamber while effectively disposing the exhaust pipe.

In an exhaust structure of a motorcycle according to an embodiment of the present invention, while the mass is concentrated by disposing the expansion chamber forming a muffler in the vicinity of the engine, the exhaust pipe from the exhaust port to the expansion chamber is effectively disposed such that the exhaust pipe has a sufficient length by being disposed long to allow the engine to sufficiently exhibit its performance. Therefore, it is possible to dispose the expansion chamber in the vicinity of the engine and ensure a sufficient length of the exhaust pipe to the expansion chamber. Further, it is possible to concentrate the mass to allow the engine to sufficiently exhibit its performance, and improve mobility of the motorcycle. Further, it is possible to easily increase the volume of an expansion chamber, effectively remove the exhaust noise, and achieve the mass concentration by increasing the mass in the vicinity of the engine. Furthermore, when this is applied to a motorcycle having a structure wherein a muffler having another expansion chamber is connected to the lower stream of the expansion chamber, the volume of the expansion chamber increases and it is correspondingly possible to decrease the volume of a second expansion chamber of the muffler without decreasing the performance of removing noise, and to reduce the weight of the muffler disposed apart from the engine and further achieve mass concentration. In addition, it is possible to ensure a sufficient length of the exhaust pipe from the exhaust port to the expansion chamber and effectively dispose the exhaust pipe.

Further, it is possible to effectively remove exhaust noise by the expansion chamber and the second expansion chamber. Further, since the second exhaust pipe is disposed inside the main body frame on the inner side of the pivot plate, it is possible to reduce the width of the motorcycle, protect the second exhaust pipe from outer force or the like, there is an advantage that a degree of freedom in design of the main body is increased.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Embodiments of the present invention will be described hereafter in detail with reference to the accompanying drawings. The following description will be made on the basis of the direction of the main body. In detail, "up," "down," "front," "rear," "left" and "right" indicate each direction such as "up," "down," "front," "rear," "left" and "right" of the main body.

Figure 1:
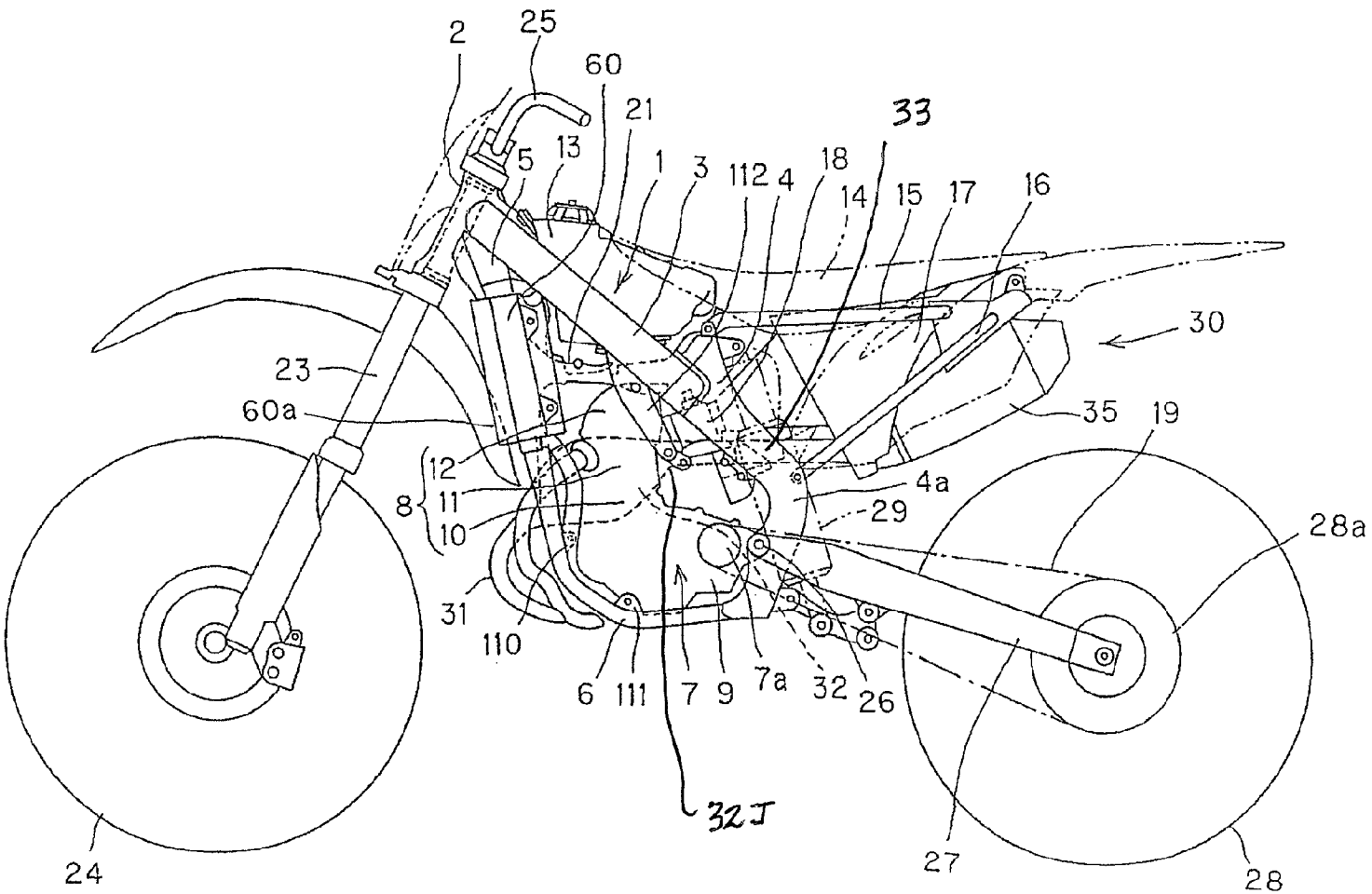
FIG. 1 is a side view of a motorcycle according to a first embodiment of the present invention.

FIG. 1 is a side view of an off-road motorcycle according to a first embodiment where the present invention is applied.

A main body frame 1 of a motorcycle according to the first embodiment includes a head pipe 2, main tubes 3, center frames 4, a down tube 5, and lower frames 6, which are connected in a loop shape and an engine 7 is supported therein. The engine 7 includes a cylinder 8 extending upward from a crankcase 9. The main tubes 3, center frames 4, and lower frames 6 are each disposed in a pair at the left and right sides, whereas one head pipe 2 and one down tube 5 are disposed along the center in the left-right direction of the main body.

The main tube 3 extends down rearward at an angle in a straight line above the engine 7 from the head pipe 2 disposed at the front of the main body and is connected to the upper end of the center frame 4 extending in the up-down direction behind the engine 7. The down tube 5 extends down at an angle in front of the engine 7 from the head pipe 2 and is connected to the front end of the lower frame 6 in front of the cylinder 8. The lower frame 6 bends down from the crankcase 9 in front of the crankcase 9 and extends rearwardly in a substantially straight line under the crankcase 9, of which the rear end is connected to the lower end of the center frame 4.

A frame is suspended in the width direction of the main body from the upper ends to the lower ends of the center frames 4 to mutually connect the center frames 4 at the left and right sides. Further, each of the center frames 4 has a pivot plate 4*a* where a pivot shaft 26 supporting a rear arm 27 is inserted.

Further, a stiffener 21 connecting the middle portion in the up-down direction of the down tube 5 with the rear portions of the left and right main tubes 3 is mounted above the engine 7. The stiffener 21 is an arm-shaped frame reinforcing member.

The engine 7 is a water-cooled four-cycle single-cylinder engine, the cylinder 8 is mounted in front of the crankcase 9 while the axial line of the cylinder is slightly inclined to the front side, and has a cylinder block 10, a cylinder head 11, and a head cover 12 that are sequentially disposed from the bottom to the top. A cylinder portion (not shown) where a piston (not shown) can reciprocate up/down is formed in the cylinder block 10. Further, the cylinder 8 is substantially disposed vertically, such that the length in the front-rear direction of the engine 7 is shortened and the engine 7 is suitable for off-road motorcycles. The center of gravity of the motorcycle is positioned in the vicinity of the engine 7.

A fuel tank 13 is supported on the main tube 3 above the engine 7. A built-in fuel pump (not shown) is accommodated in the fuel tank 13, such that high-pressure fuel is supplied to a throttle body 18 from the fuel pump through a fuel supply pipe.

A seat 14 is disposed behind the fuel tank 13 and supported on a seat rail 15 extending rearward from the upper ends of the center frames 4. A rear frame 16 is connected under the seat rail 15. An air cleaner box 17 is supported to the seat rail 15 and the rear frame 16, such that air flowing in the air cleaner box 17 and cleaned therein becomes gas mixture through the throttle body 18 and the gas mixture is sucked into the cylinder head 11 from the rear side of the main body.

A pair of left and right front forks 23 is supported to the head pipe 2, such that a front wheel 24 supported to the lower ends of the front forks 23 is steered by a handlebar 25 attached to the upper ends of the front forks 23.

For the down tube 5, radiators 60 are mounted at the left and right sides across the down tube 5. The radiators 60 are mounted from the lower portion of the head pipe 2 to the front portion of the cylinder head 11 in the up-down direction, along the down tube 5. Further, radiator grills 60*a* that guide flow of air while protecting the radiators 60 are attached to the radiators 60.

The front end of the rear arm 27 is connected to the center frame 4 through the pivot shaft 26 and the rear arm 27 is swingably supported. A rear wheel 28 is supported to the rear end of the rear arm 27 and driven by a driving chain 19 wound around a driving sprocket 7*a* of the engine 7 and a driven sprocket 28*a* of the rear wheel 28. A shock absorber 29 of a rear suspension is mounted between the rear arm 27 and the rear ends of the center frames 4.

Further, the engine 7 is supported to the main body frame 1 by engine mounts 110, 111, an engine hanger 112, and the pivot shaft 26.

Figure 2:
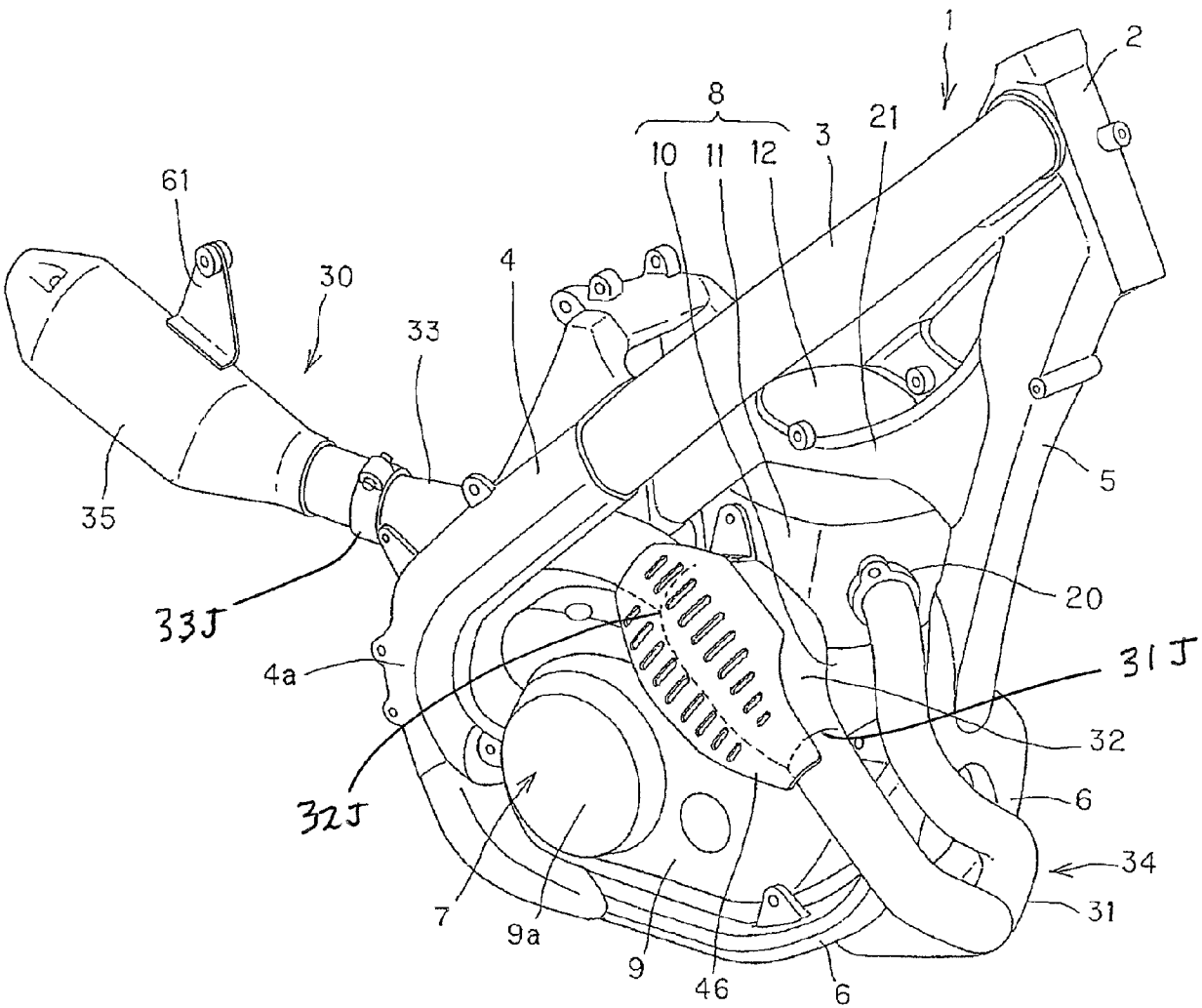
FIG. 2 is a perspective view of an engine mounted on a main body frame, seen from the front right side of the main body.
Figure 3:
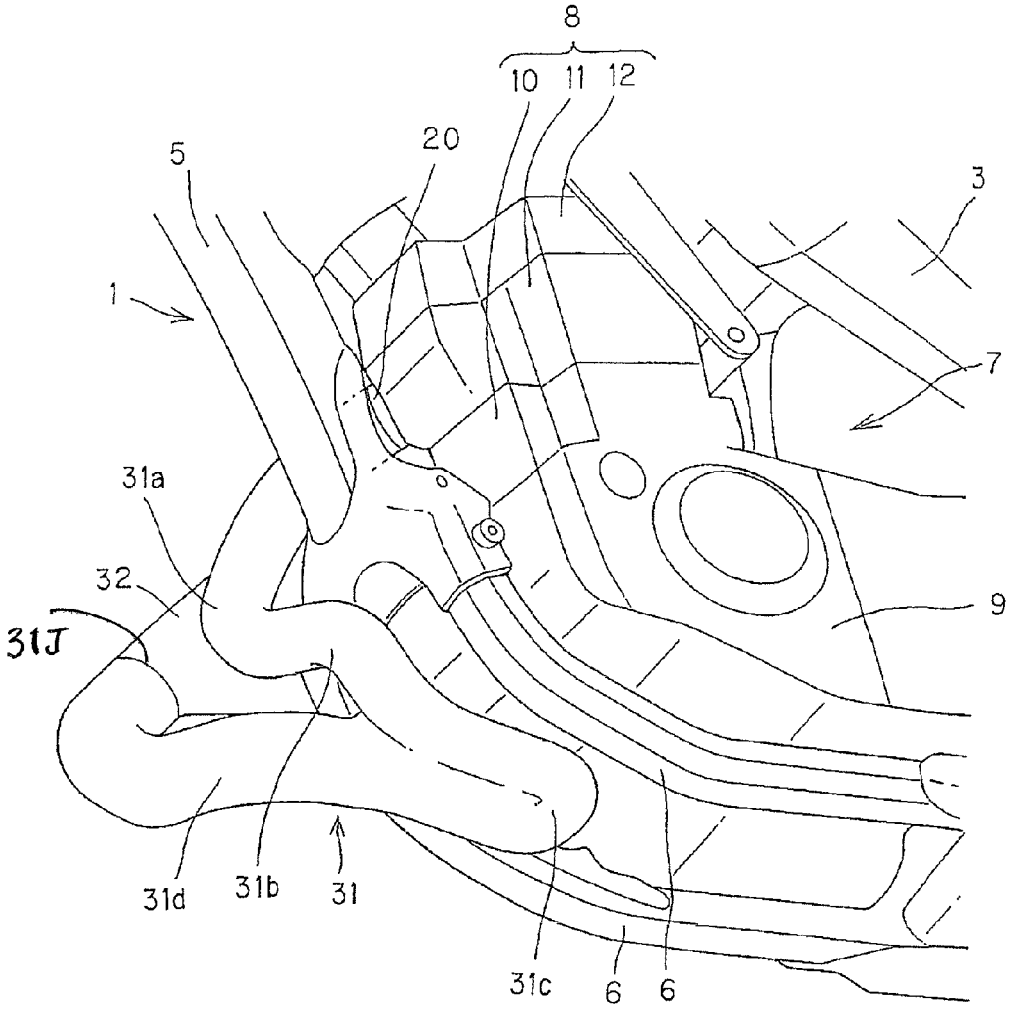
FIG. 3 is a perspective view of the engine seen from the lower left side of the main body.

FIG. 2 is a perspective view of the engine 7 mounted to the main body frame 1, seen from the front right side of the main body. FIG. 3 is a perspective view of the engine 7 seen from the left bottom of the main body. Further, FIG. 4 is a plan view of a pipe section 34 seen from above the main body.

The engine 7 includes an exhaust unit 30 that exhausts a gas mixture burned in the engine 7 to the outside. The exhaust unit 30 includes the pipe section 34 having a first exhaust pipe 31 (exhaust pipe) connected to the exhaust port 20 of the engine 7, a chamber 32 (expansion chamber) connected to the first exhaust pipe 31, and a second exhaust pipe 33 (second exhaust pipe) connected to the chamber 32 and extending rearwardly; and a muffler 35 connected to the pipe section 34.

The exhaust port 20 is deviatingly opened at the light side from the center line in the left-right direction of the main body. The exhaust port 20 is open to the front of the cylinder head 11 behind the down tube 5 and faces down at an angle at the right side of the main body. Further, the exhaust port 20 is positioned higher than the joint of the down tube 5 and the lower frames 6 in the height direction of the main body and positioned in the vicinity the middle portion in the up-down direction of the down tube 5.

Figure 4:
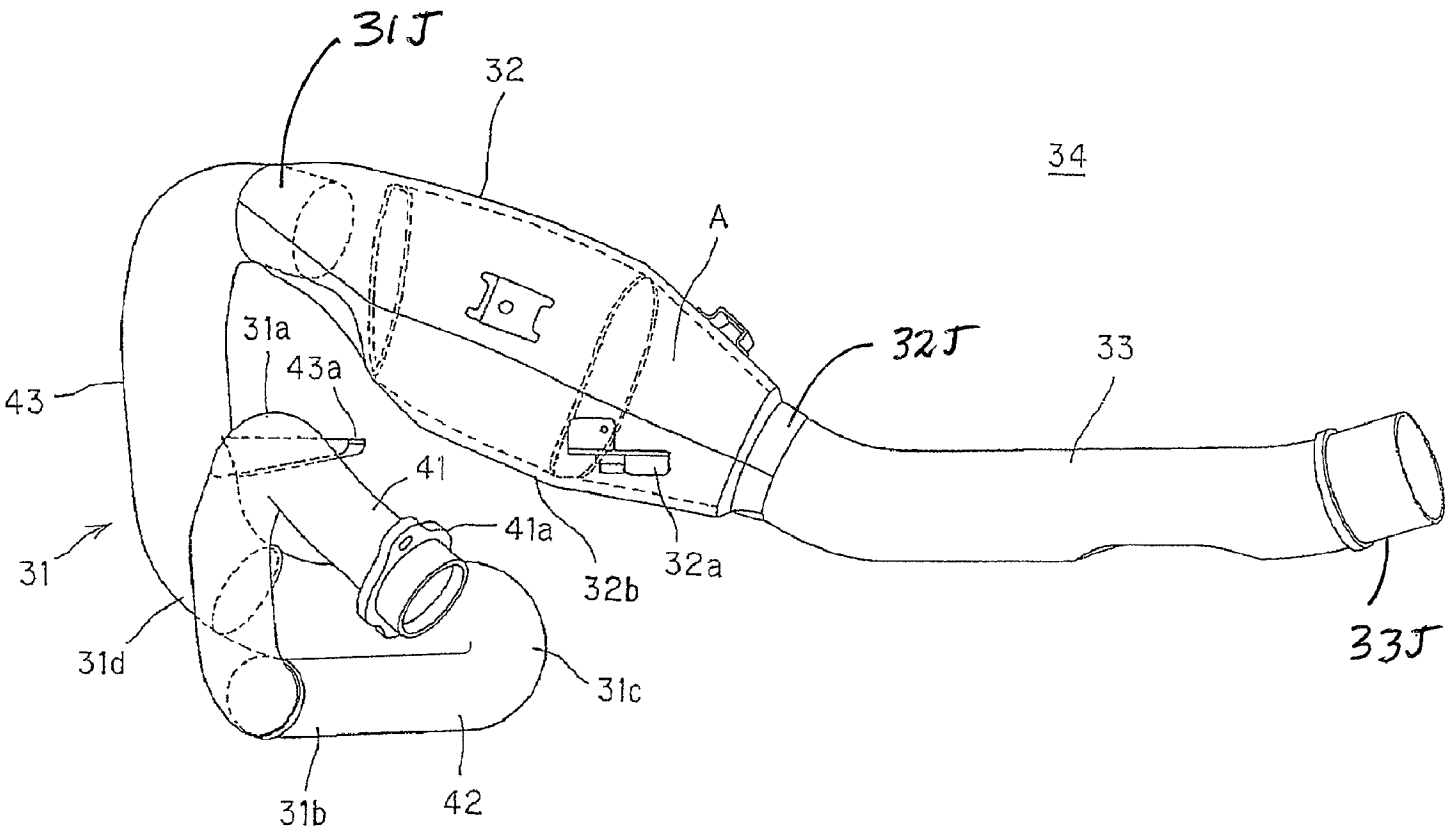
FIG. 4 is a plan view of a pipe section, seen from above the main body.

As shown in FIGS. 2 to 4, the first exhaust pipe 31 is connected to the exhaust port 20 at the right side of the main body, extends down forward at an angle at to the right side of the main body, bends to the left side of the main body at a first bending portion 31*a* in front of the joint of the down tube 5 and the lower frames 6, and then extends downward. Next, the first exhaust pipe 31 extends down to the left side of the main body, reaches the left side of the down tube 5 disposed on the center line in the left-right direction of the main body, bends along the curve of the lower frame 6 at a second bending portion 31*b* in front of the lower frame 6 at the left side of the main body, and then extends to the rear side of the main body.

Further, the first exhaust pipe 31 extends rearward under the crankcase 9, extends to the front side of the main body while turning at 180 degrees at a third bending portion 31*c* to the inside of the main body, bends to the upper right side of the main body at a fourth bending portion 31*d* under the first bending portion 31*a*, extends toward the right side of the down tube 5, and then reaches the front side of the lower frame 6 at the right side of the main body. Thereafter, the first exhaust pipe 31 bends to the side of the cylinder 8 across the outer side of the lower frame 6 and is connected to the chamber 32 at the right side of the first bending portion 31*a*. The first exhaust pipe 31 turns at 180 degrees at the third bending portion 31*c* and the exhaust pipes are mutually connected.

More specifically, the exhaust port 20 is deviatingly open to a side from the center line in the left-right direction of the main body, the first exhaust pipe 31 connected to the exhaust port 20 extends forward from a side of the down tube 5, extends downward in front of the down tube 5, turns under the crankcase 9 and extends again to a side, and is then connected to the chamber 32 provided to one side of the cylinder 8 at one side.

Figure 5:
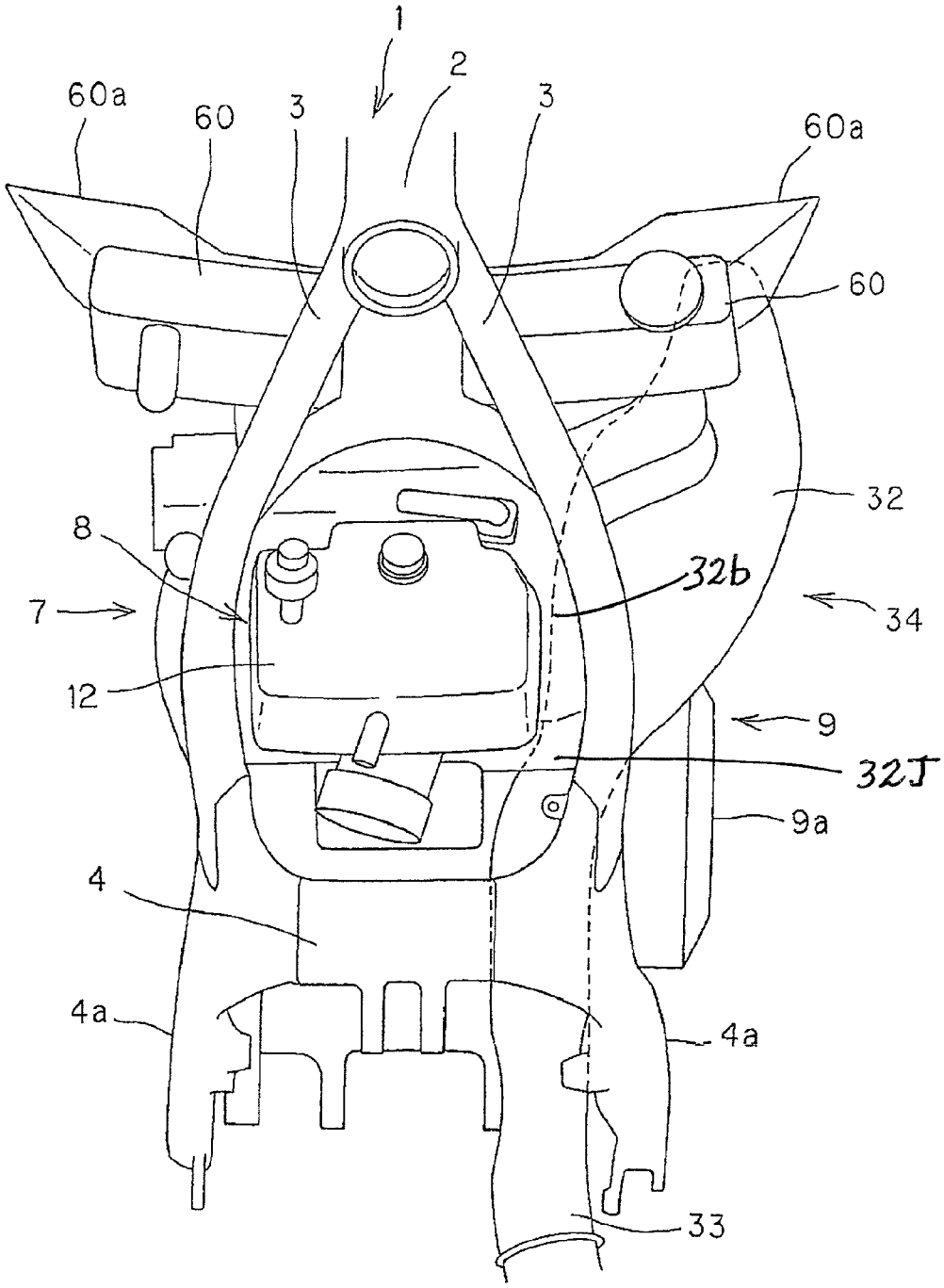
FIG. 5 is a plan view of the main body seen from above.

FIG. 5 is a plan view of the main body seen from above. In FIG. 5, the fuel tank 13 and the seat 14 are removed.

As shown in FIGS. 2 to 5, the chamber 32 is mounted to the right side of the cylinder 8. In detail, the chamber 32 is positioned under the right main tube 3, and on the front upper side of a clutch storage portion 9*a* protruding to the right side in the crankcase 9, and at the light side of the cylinder 8. Further, in the front-rear direction of the main body, the front end of the chamber 32 is positioned under the right radiator 60 and the rear end of the chamber 32 is positioned at the right side of the rear end of the cylinder head 11. Further, in the width direction of the main body, the chamber 32 protrudes further outside than the right main tube 3 and is positioned further inside the main body than the right radiator grill 60*a*. Further, the chamber 32 is disposed at an extra space at one side of the cylinder 8 under the right main tube 3, such that the volume is large.

Further, the second exhaust pipe 33 is connected to the rear end of the chamber 32, and connected to the muffler 35 disposed at the rear side, that is, the rear portion of the main body, through a pivot plate 4*a* of the right center frame 4.

Figure 6:
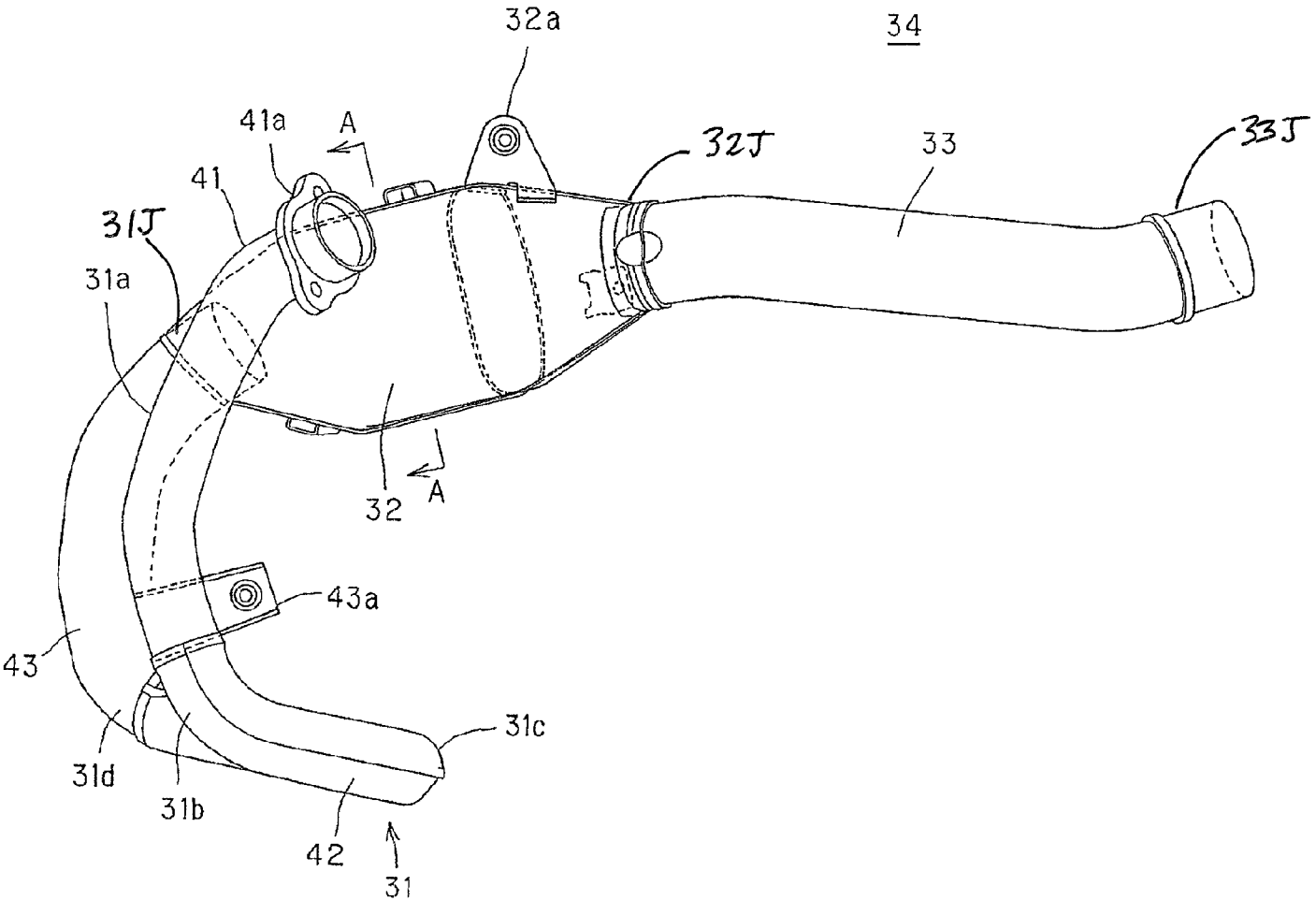
FIG. 6 is a side view of the pipe section, seen from the left side.
Figure 7:
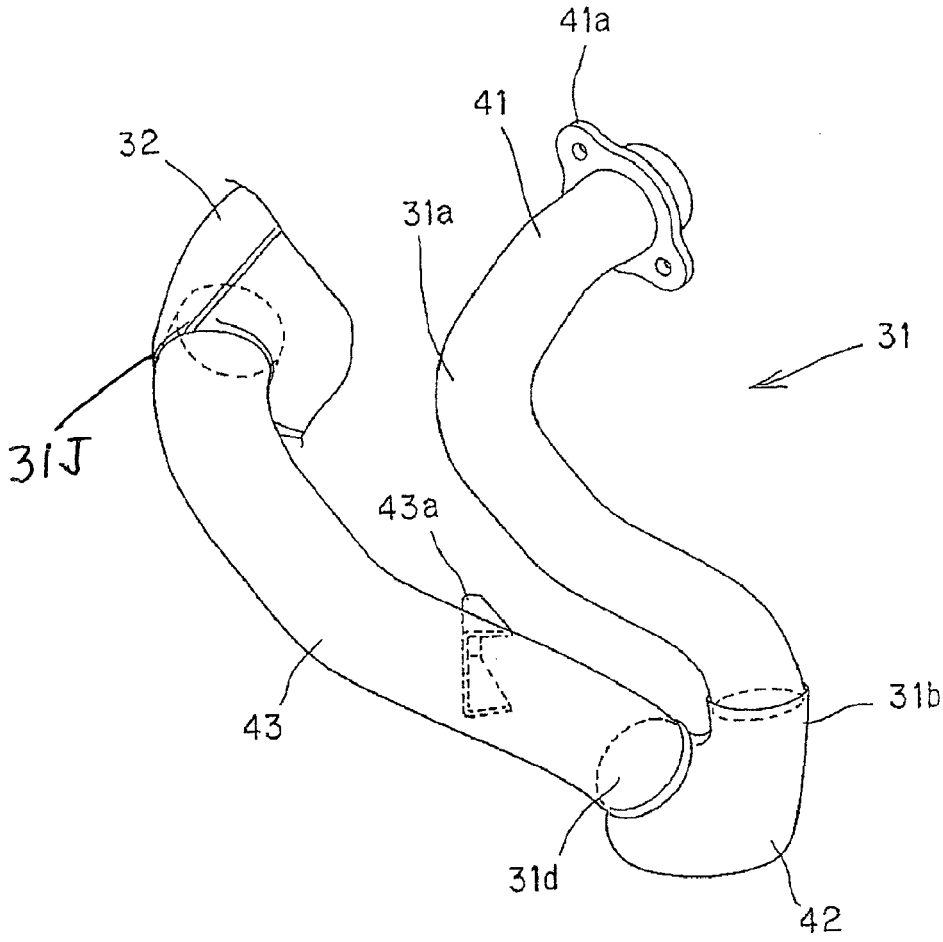
FIG. 7 is a front view of the pipe section, seen from the front.

FIG. 6 is a side view of the pipe section 34 seen from the left side. FIG. 7 is a front view of the pipe section 34 seen from the front side of the main body.

The pipe section 34 is formed by joining five pipe-shaped members. In detail, the pipe section 34 includes a first pipe 41 forming the portion from the exhaust port 20 to the front side of the second bending portion 31*b*, a second pipe 42 forming the portion from the second bending portion 31*b* to the front side of the fourth bending portion 31*d*, a third pipe 43 forming the portion from the fourth bending portion 31*d* to the joint with the chamber 32, the chamber 32, and the second exhaust pipe 33.

The diameter of the second pipe 42 is larger than the diameter of the first pipe 41 and the diameter of the third pipe 43 is larger than the diameter of the second pipe 42. Further, the diameter of the second exhaust pipe 33 is larger than the diameter of the third pipe 43. Therefore, as the diameter of the first exhaust pipe 31 increases by stages from the upper stream to the lower stream of the exhaust, resistance in the exhaust is reduced and high exhaust effect can be achieved. Further, the same effect can be achieved even if a portion of or the entire first exhaust pipe 31 is tapered such that the diameter increases in a smooth shape from the upper stream to the lower stream. Further, the first exhaust pipe 31 is formed by compounding the minimum distortions within a range of distortion that does not reduce output of the engine 7, such that the exhaust effect is high. Further, because the pipe section 34 is positioned at a distance from other parts of the motorcycle, exhaust heat does not influence the parts.

As shown in FIG. 4, the chamber 32 is a pipe that is tapered to increase the diameter from the joint 31J with the first exhaust pipe 31, subsequently extends to the lower stream of the exhaust at a substantially constant diameter, and is tapered toward the joint 32J with the second exhaust pipe 33. Further, the diameter of the chamber 32 is sufficiently larger than that of the third pipe 43 at the upper stream of the exhaust from the chamber 32, such that exhaust gas flowing into the chamber 32 through the third pipe 43 expands in the chamber 32 and the pressure drops. That is, the chamber 32 functions as a first expansion chamber A in the exhaust unit 30. Further, as can be seen with reference to FIG. 1, joint 32J of chamber 32 is disposed near a lower portion of throttle body 18, and second exhaust pipe 33 extends rearwardly and substantially horizontally from joint 32J of chamber 32 to joint 33J of second expansion chamber B of muffler 35 (See FIGS. 1, 2, 6, and 10).

Further, as shown in FIG. 5, in the chamber 32, the joint 31J with the first exhaust pipe 31 is positioned outside the main body and the joint 32J with the second exhaust pipe 33 is positioned inside from the pivot plate 4*a*. Accordingly, the entire chamber 32 is formed into a shape that it is inserted inside the main body toward the rear side from the front side of the main body, more particularly, the inner sidewall 32*b* corresponding to the side surface on the inner side of the main body is a surface inclined from the outside to the inside from the front to the rear of the main body. In other word, the inner sidewall 32*b* of the chamber 32 in the inner direction of the main body is inclined such that it widens outside the main body toward the front side of the main body. Therefore, length for flowing exhaust gas in the chamber 32 can be lengthened, as compared with the length of the chamber 32 in the front-rear direction. In addition, as can be seen in FIG. 2, chamber 32 (first expansion chamber A) is disposed at a position directly above clutch storage portion 9*a* protruding to the right side in the crankcase 9. When the first expansion chamber A is viewed in a side view (FIGS. 2, 6, and 10, for example), an upper-most portion of the first expansion chamber A can be seen to be disposed entirely below where a head cover 12 is attached to a cylinder head 11 of the engine 7. Further, as can be seen with reference to FIGS. 2, 5, 8, and 10, the inner sidewall 32*b* of the first expansion chamber A faces the cylinder head 11 and the exhaust port 20, and at least a portion of the inner sidewall 32*b* facing the cylinder head 11 is substantially flat (see FIGS. 5 and 8).

Further, the joint of the chamber 32 and the first exhaust pipe 31 is positioned near to the outside the main body, such that the first exhaust pipe 31 can have a large length in the width direction of the main body.

Further, in the first exhaust pipe 31, the portion extending forward from the exhaust port 20 is mounted along the inner sidewall 32*b* and widened outside toward the front side, such that the first exhaust pipe 31 can have a large length as compared with when the portion extends forward in a straight line.

Figure 8:
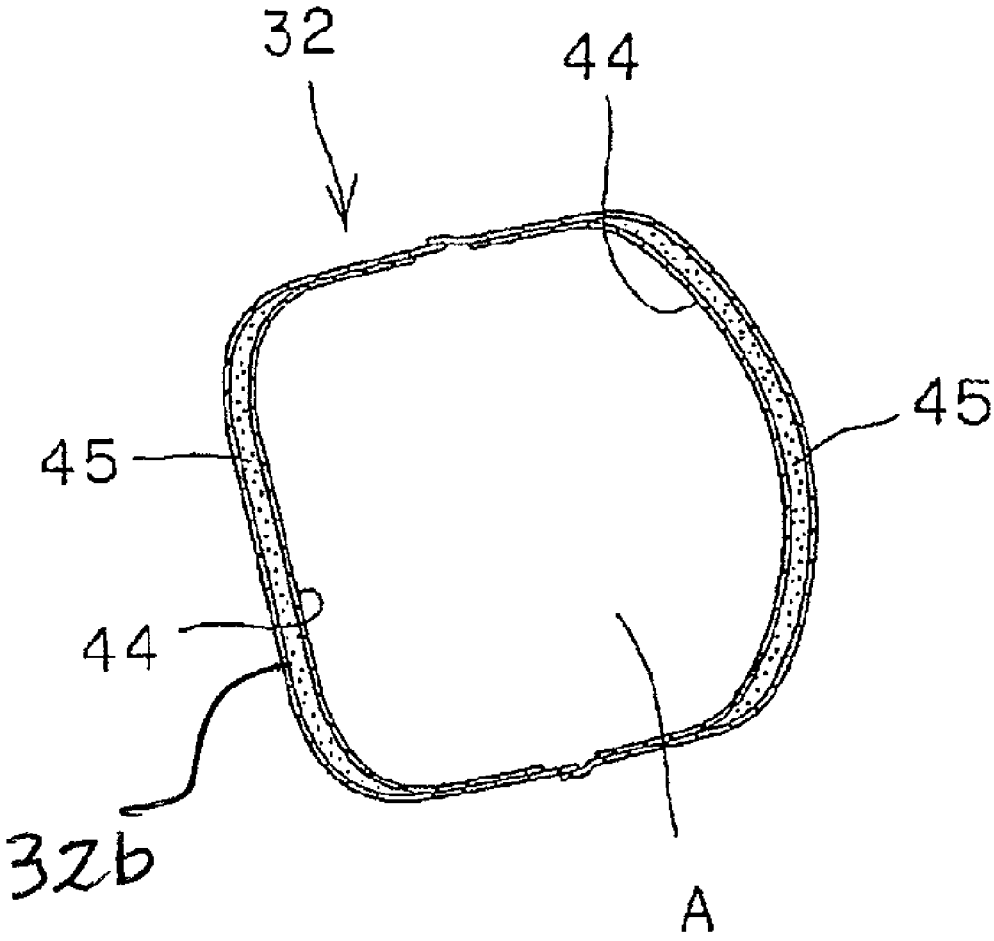
FIG. 8 is a cross-sectional view of a chamber taken along the line A-A in FIG. 6.

FIG. 8 is a cross-sectional view of the chamber 32 taken along the line A-A in FIG. 6.

Inner walls 44 are formed on the inner sides of the left and right sidewalls in the chamber 32 and a double wall is formed by the inner walls 44. A glass wool 45 that reduces exhaust noise is mounted between the sidewall and the inner walls 44. Further, the inner space of the chamber 32 surrounded by the inner walls 44, that is, the volume of the first expansion chamber A is larger than the volumes of a second expansion chamber B (second expansion chamber) and a third expansion chamber C of the muffler 35.

This is because the chamber 32 is entirely mounted at an angle as described above, there are few obstructions that restricts the volume of the chamber 32 in a position where the chamber 32 is disposed. Thus, a large volume can be achieved. That is, since there is generally no obstruction at one side of the cylinder 8 where the chamber 32 is disposed, it is possible to increase the volume of the chamber 32 by extending the outer sidewall of the chamber 32. Further, it is also possible to increase the volume of the chamber 32 by extending the surface on the sidewalls of the chamber 32, corresponding to the bottom.

Further, as shown in FIG. 4, the pipe section 34 has a flange 41*a* mounted to the base of the first pipe 41, a stay 43*a* vertically disposed in the third pipe 43, and a stay 32*a* vertically disposed in the chamber 32. The pipe section 34 is attached to the exhaust port 20 of the engine 7 by the flange 41*a* and fixed to the main body frame 1 through the stays 43*a*, 32*a*. Further, as shown in FIG. 2, a cover 46 that covers the outer surface of the main body of the chamber 32 is mounted on the chamber 32. The cover 46 is made to lighten in a net shape.

Figure 9:
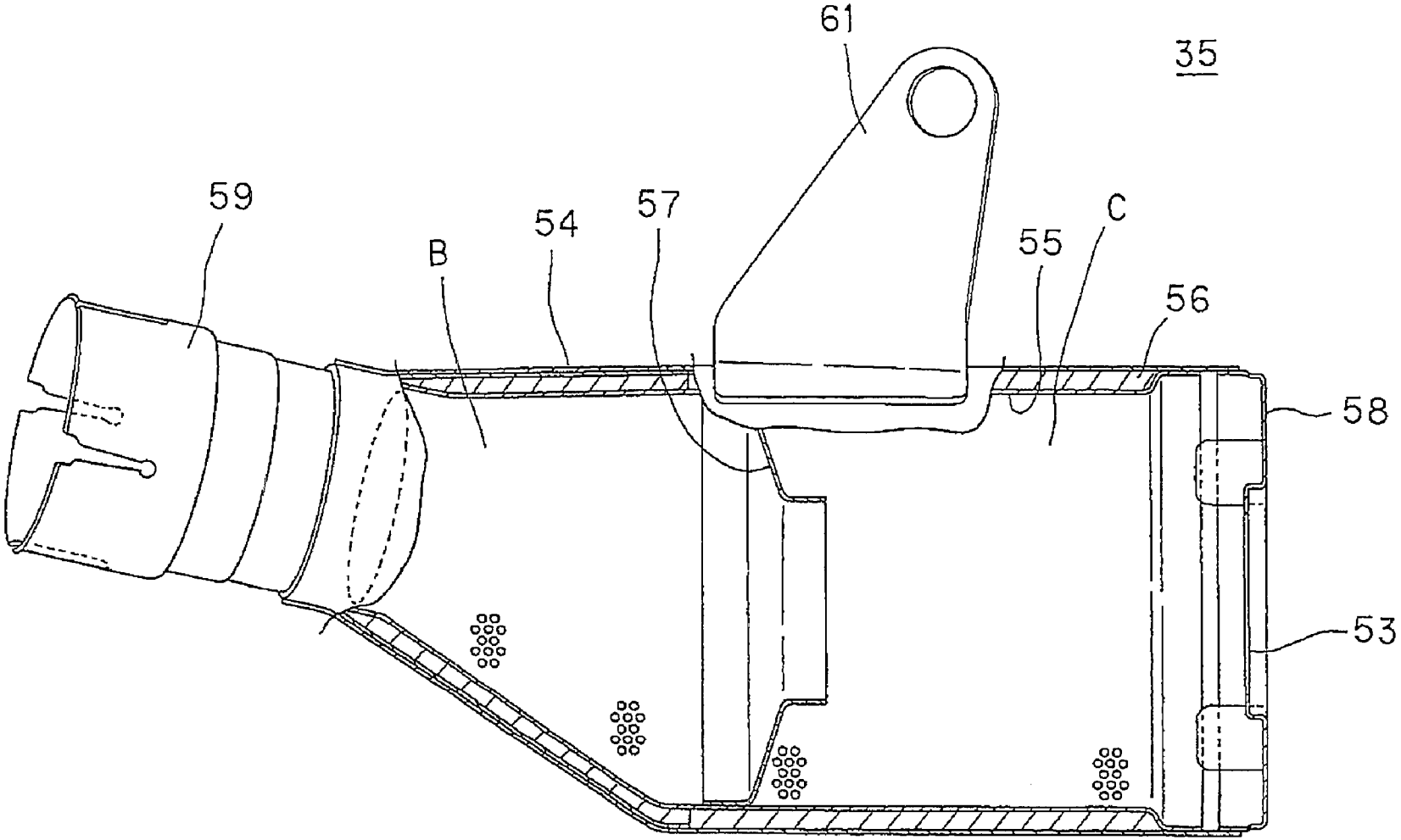
FIG. 9 is a cross-sectional view of a muffler.

FIG. 9 is a cross-sectional view of the muffler 35.

The muffler 35 includes an outer cylinder 54 having an elliptical cross section, an inner cylinder 55 accommodated in the outer cylinder 54, a sound-absorbing member 56 mounted between the outer cylinder 54 and the inner cylinder 55, a separating wall 57 dividing the muffler 35 into front and back, a cover section 58 mounted to the rear end of the muffler 35, and a connecting pipe 59 connected to the second exhaust pipe 33. The inner cylinder 55 is formed by punching metal.

The inner space inside of the muffler 35 is divided into the second expansion chamber B at the upper stream of exhaust and the third expansion chamber C at the lower stream by the separating wall 57 mounted to the middle portion of the muffler 35, and the cover section 58 is disposed at the end of the third expansion chamber at the lower stream. The separating wall 57 is a member having an outer circumference that is bonded to the inner circumference of the inner cylinder 55, is tapered toward the lower stream of exhaust from the outer circumference such that the diameter decreases, and is open at the center portion. Further, a rear exhaust port 53 through which exhaust gas that is discharged outside is formed in the center portion of the cover section 58. Further, the second expansion chamber B itself is tapered toward the lower stream of exhaust such that the diameter increases. The muffler 35 is supported to the rear frame 16 at the left side of the main body through a stay 61 mounted to the outer cylinder 54.

In the exhaust unit 30, since the chamber 32 has the first expansion chamber A having a large volume, the second expansion chamber B and the third expansion chamber C of the muffler 35 are miniaturized, such that the muffler 35 is light.

Exhaust gas of the engine 7 passing through the exhaust unit 30 passes through the first exhaust pipe 31 from the exhaust port 20, first largely expands in the first expansion chamber A of the chamber 32, decreases in pressure, and passes through the second exhaust pipe 33. The exhaust gas further expands in the second expansion chamber B and the third expansion chamber C of the muffler 35, decreases in pressure, and is then discharged outside through the rear exhaust port 53. Therefore, in the exhaust unit 30, since the muffler 35 has the second expansion chamber B and the third expansion chamber C and the chamber 32 of the pipe section 34 has the first expansion chamber A having large volume, capability for removing exhaust noise is large. Further, since it is possible to ensure sufficient length of the first exhaust pipe 31 to allow the engine 7 to exhibit its performance by making the first exhaust pipe 31 long and effectively disposing the first exhaust pipe 31, the first expansion chamber A can be disposed in the vicinity of the engine 7. As described above, so-called mass concentration in which the heavy parts are disposed close to the center of gravity by disposing the first exhaust pipe 31 and the first expansion chamber A in the vicinity of the engine 7, such that the mobility of the motorcycle is improved.

As described above, according to the first embodiment where the present invention is applied, the first exhaust pipe 31 extends from the exhaust port 20 that is deviatingly open at a side from the center line of the main body to the lower area of the crankcase 9 through the front side of the down tube 5, turns, extends again to a one side and is then connected to the first expansion chamber A disposed to a side of the cylinder 8 at the one side.

More specifically, while the mass is concentrated by disposing the first expansion chamber A forming a muffler in the vicinity of the engine 7, the first exhaust pipe 31 is disposed such that the first exhaust pipe 31 has a sufficient length by being disposed long to allow the engine 7 to exhibit its performance. Therefore, it is possible to dispose the first expansion chamber A in the vicinity of the engine 7 and ensure a sufficient length of the first exhaust pipe 31. Further, it is possible to concentrate the mass to allow the engine 7 to sufficiently exhibit its performance, and improve mobility of the motorcycle.

Further, since it is easy to ensure a space at one side of the cylinder 8 where the chamber 32 is mounted, it is easy to increase the volume of the first expansion chamber A of the chamber 32 disposed at the side of the cylinder 8. Therefore, as the volume of the first expansion chamber A increases, exhaust noise can be considerably removed. Further, as the large chamber 32 is mounted to the side of the cylinder 8 and the first exhaust pipe 31 having a length larger than a predetermined length is disposed in the vicinity of the front side of the engine 7, the mass can be concentrated.

In addition, it is possible to decrease the size of the muffler 35 by decreasing the volumes of the second expansion chamber B and the third expansion chamber C of the muffler 35 without decreasing the performance of removing the exhaust noise by increasing the volume of the first expansion chamber A. Therefore, by decreasing the size and weight of the muffler 35 at a higher position apart from the engine 7, it is possible to achieve further mass concentration and low center of gravity, and improve the mobility of the motorcycle.

Further, since the inner sidewall 32*b* of the first expansion chamber A is inclined to be widened to the outside of the main body toward the front side of the main body, it is possible to increase the length of the chamber 32 without increasing the size from front to back of the main body of the chamber 32. Further, the inner sidewall 32*b* is inclined and the joint of the chamber 32 and the first exhaust pipe 31 is off-set to the outside of the main body, such that the first exhaust pipe 31 further extends to the outside of the main body. Accordingly, it is possible to dispose the first exhaust pipe for ensuring the length of the first exhaust pipe 31. Furthermore, in the first exhaust pipe 31, since the portion extending forward from the exhaust port 20 is inclined to the outside toward the front side, the first exhaust pipe 31 goes a long way and the first exhaust pipe 31 can be efficiently disposed to have a predetermined length.

In addition, since the exhaust gas expanding in the first expansion chamber A further expands in the second expansion chamber B and the third expansion chamber C, it is possible to improve the effect of removing exhaust noise. Further, since the second exhaust pipe 33 is disposed inside the main body frame 1 on the inner side of the pivot plate 4*a*, the width of the motorcycle is reduced and the second exhaust pipe 33 can be protected from outer force or the like.

A second embodiment where the present invention is applied will be described.

In the second embodiment, the same parts as in the first embodiment are represented by the same reference numerals and detailed description is not provided.

An exhaust unit 130 described in the second embodiment has a pipe section 134 including a first exhaust pipe 131 that is at a different disposition from the first exhaust pipe 31, instead of the pipe section 34 described in the first embodiment.

Figure 10:
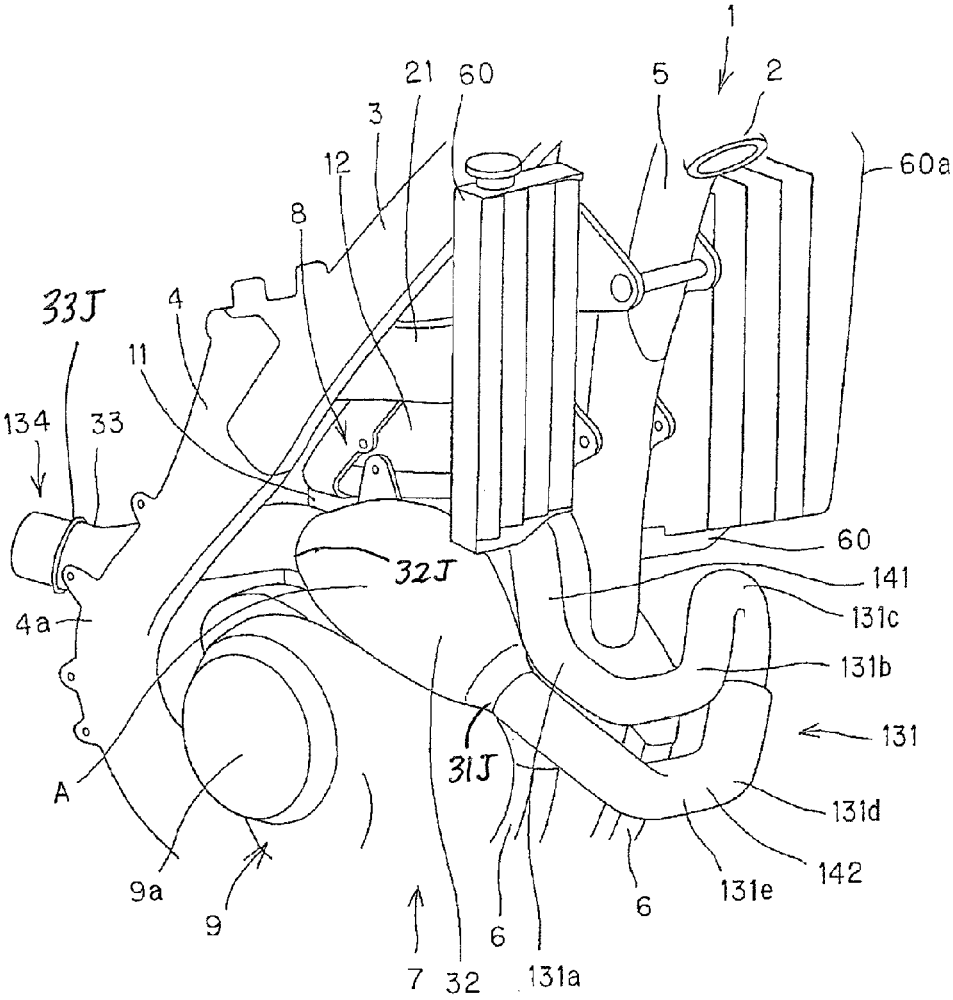
FIG. 10 is a perspective view of an engine according to a second embodiment of the present invention, seen from the front light side of the main body.
Figure 11:
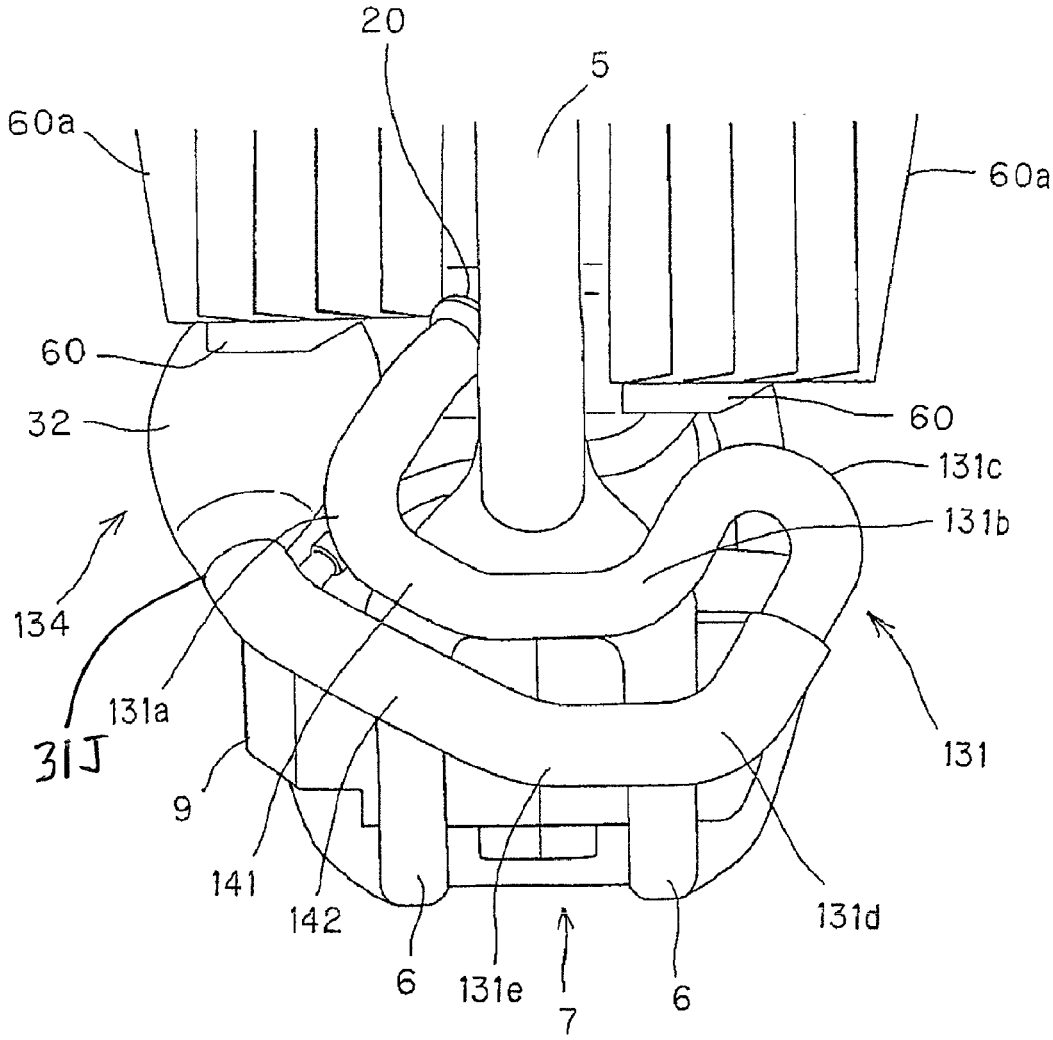
FIG. 11 is a front view of the engine, seen from the front.

FIG. 10 is a perspective view of the engine 7 mounted on the main body frame 1, seen from the front right side of the main body. FIG. 11 is a front view of the engine 7 seen from the front.

The pipe section 134 includes the first exhaust pipe 131 connected to the exhaust port 20, the chamber 32 connected to the first exhaust pipe 131, and the second exhaust pipe 33 connected to the chamber 32.

As shown in FIGS. 10 and 11, the first exhaust pipe 131 is connected to the exhaust port 20 at the right side of the main body, extends down forward at the right side of the main body, turns to the left side of the main body at a first bending portion 131*a* in front of the joint of the down tube 5 and the lower frame 6, and then extends to the left side of the main body substantially horizontally across the center line in the left-right direction of the main body passing through the center of the down tube 5. Further, the first exhaust pipe 131 bends upwardly at an angle to the left side of the main body at a second bending portion 131*b* in front of the lower frame 6 at the left side of the main body, turns in a U-shape at a third bending portion 131*c* under the left radiator 60, and then extends to the right lower side. Furthermore, the first exhaust pipe 131 bends to the right side of the main body at a fourth bending portion 131*d* in front of the lower frame 6 at the left side of the main body, and then extends substantially horizontally under the second bending portion 131*b*. Thereafter, the first exhaust pipe 131 bends to the right upper side of the main body at a fifth bending portion 131*e* around the center line, across the center line, and then bends to a side of the cylinder 8 at the right side of the first bending portion 13 la and is connected to the chamber 32. The radiator 60 at the right side of the main body has a shorter length in the up-down direction than the radiator 60 at the left side to maintain a distance from the chamber 32. Further, as shown in FIG. 11, the width of the pipe section 134 in the width direction of the motorcycle is in the widths of the left and right radiator grills 60*a* in the width direction of the motorcycle.

More specifically, the exhaust port 20 is deviatingly open at one side from the center line in the left-right direction of the main body, the first exhaust pipe 131 connected to the exhaust port 20 extends forward from one side of the down tube 5, extends to the other side of the down tube 5 at the front side of the down tube 5, subsequently bends upward from the other side, and turns and extends downward around the bottom of the radiator 60 at the other side. Further, the first exhaust pipe 131 extends again to a side at the front side of the crankcase 9 and subsequently is connected to the chamber 32 disposed at one side of the cylinder 8 at a side.

The first exhaust pipe 131 is formed by joining two pipe-shaped members. In detail, the first exhaust pipe 131 includes a first pipe 141 forming the portion from the exhaust port 20 to the middle portion between the third bending portion 131*c* and the fourth bending portion 131*d*, and a second pipe 142 forming the portion from the middle portion to the connecting portion with the chamber 32.

The diameter of the second pipe 142 is larger than the diameter of the first pipe 141, and the diameter of the second exhaust pipe 33 is larger than the diameter of the second pipe 142. Since the diameter of the first exhaust pipe 131 increases by stages from the upper stream to the lower stream of the exhaust, resistance in the exhaust is reduced and high exhaust efficiency can be achieved. Further, the same effect can be achieved even if a portion of or the entire first exhaust pipe 131 is tapered such that the diameter increases in a smooth shape from the upper stream to the lower stream. Further, the first exhaust pipe 131 is formed by compounding the minimum distortions within a range of distortion that does not reduce output of the engine 7, such that the exhaust effect is high. Further, because the first exhaust pipe 131 is positioned at an appropriate distance from parts of the motorcycle, exhaust heat does not influence the parts.

Exhaust gas of the engine 7 passing through the exhaust unit 130 passes through the first exhaust pipe 131 from the exhaust port 20, first largely expands in the first expansion chamber A of the chamber 32, decreases in pressure, and then passed through the second exhaust pipe 33. The exhaust gas further expands in the second expansion chamber B and the third expansion chamber C of the muffler 35, decreases in pressure, and then is discharged outside through the rear exhaust port 53. Therefore, in the exhaust unit 130, since the muffler 35 has the second expansion chamber B and the third expansion chamber C and the chamber 32 of the pipe section 134 has the first expansion chamber A having large volume, capability of removing exhaust noise is large. Further, since it is possible to ensure a sufficient length of the first exhaust pipe 131 to allow the engine 7 to exhibit its performance by making the first exhaust pipe 131 long and effectively dispose the first exhaust pipe 131, the first expansion chamber A can be disposed in the vicinity of the engine 7. As described above, mass concentration can be achieved by disposing the first exhaust pipe 131 and the first expansion chamber A in the vicinity of the engine 7, such that the mobility of the motorcycle is improved.

As described above, according to the second embodiment where the present invention is applied, the first exhaust pipe 131 first extends forward from the exhaust port 20 that is deviatingly open at one side from the center line of the main body, extends to the other side across the center line of the main body through the front side of the down tube 5, subsequently turns, extends again to the side to which the exhaust port 20 is open, and is then connected to the chamber 32 at one side of the cylinder 8 at one side. That is, as in the first embodiment, the mass is concentrated by disposing the first expansion chamber A forming a muffler in the vicinity of the engine 7, and the first exhaust pipe 131 is effectively disposed such that the first exhaust pipe 131 has a sufficient length by being disposed long to allow the engine 7 to exhibit its performance. Therefore, it is possible to dispose the first expansion chamber A in the vicinity of the engine 7 and ensure a sufficient length of the first exhaust pipe 131. Further, it is possible to concentrate the mass to allow the engine 7 to sufficiently its performance, and improve mobility of the motorcycle.

Further, since it is easy to ensure a space at one side of the cylinder 8 where the chamber 32 is mounted, it is easy to increase the volume of the first expansion chamber A of the chamber 32 disposed at the side of the cylinder 8. Therefore, as the volume of the first expansion chamber A increases, exhaust noise can be considerably removed. Further, as the large chamber 32 is mounted to the side of the cylinder 8 and the first exhaust pipe 31 having a length lager than a predetermined length is disposed in the vicinity of the front side of the engine 7, the mass can be concentrated.

In addition, it is possible to decrease the size of the muffler 35 by decreasing the volumes of the second expansion chamber B and the third expansion chamber C of the muffler 35 without decreasing the performance of removing the exhaust noise by increasing the volume of the first expansion chamber A. Therefore, by decreasing the size and weight of the muffler 35 at a higher position apart from the engine 7, it is possible to achieve mass concentration and low center of gravity, and improve the mobility of the motorcycle.

Further, since the first exhaust pipe 131 bends upwardly at the other side of the down tube 5 and then turns downwardly and extends to one side, the first exhaust pipe 131 is long, and the first exhaust pipe 131 can be effectively disposed to have a predetermined length.

Further, the first and second embodiments show an example where the present invention is applied and the present invention is not limited thereto.

For example, although the exhaust gas is discharged through the exhaust port 20 that is open at the right side of the main body in the first and second embodiments, the present invention is not limited thereto, and the exhaust port of the engine 7 may be disposed at the left side of the main body, and as for the exhaust unit 30, symmetric exhaust units may be connected to the exhaust port. Further, although a catalyst is not provided in the chamber 32, the catalyst may be provided in the first expansion chamber A of the chamber 32. In this case, because the catalyst can be disposed close to the center of gravity the motorcycle on a side of the engine 7, the mass concentration can be achieved. As a matter of course, other detailed configurations may be optionally changed.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An exhaust structure of a motorcycle, in which a main tube is provided for extending rearwardly from a head pipe disposed at a front side of a main body, an engine is disposed under the main tube, the engine includes a cylinder extending upwardly from a crankcase, a down tube is disposed on a center line in a left-right direction of the main body, a lower frame extending downwardly from the down tube and having left and right side lower frames which are parallel to each other and which extend rearwardly under the engine, the exhaust structure comprising:

an exhaust port open at a front side of the cylinder, the exhaust port being disposed behind the down tube and being deviatingly open at a right side from the center line in the left-right direction of the main body, a first exhaust pipe connected to the exhaust port and extending downwardly and forwardly at an angle to the right side of the main body;

a first expansion chamber directly connected to a downstream end of the first exhaust pipe;

a second expansion pipe directly connected to a downstream end of the first exhaust chamber via a joint, the joint being at a position directly above a clutch storage portion protruding to the right side in the crankcase and near a lower portion of a throttle body, and a muffler having a second expansion chamber directly connected to a downstream end of the second exhaust pipe, wherein the first exhaust pipe includes at least first, second, third, and fourth bending portions, the first exhaust pipe connected to the exhaust port bends and extends down toward a left side of the main body at the first bending portion in front of the down tube, and then the first exhaust pipe bends along a curve of the lower frame at the second bending portion at a front side of the lower frame at the left side of the main body, and then the first exhaust pipe extends rearwardly and thereafter extends to the front side of the main body while being bent at the third bending portion to an inside of the main body, and then the first exhaust pipe bends to an upper one side of the main body at the fourth bending portion under the first bending portion, and is connected to the first expansion chamber, wherein the third bending portion has a U-shape, is arranged on the center line in the left-right direction of the main body, and opens toward the front of the motorcycle, and portions of the first exhaust pipe extending forwardly from left and right sides of the U-shaped third bending portion are arranged between and are substantially parallel to portions of the left and right side lower frames extending rearwardly under the engine, and when the first expansion chamber is viewed in side view, an upper-most portion of the first expansion chamber can be seen to be disposed entirely below where a head cover is attached to a cylinder head of the engine, wherein the first expansion chamber has an inner sidewall facing the cylinder head and the exhaust port, and at least a portion of the inner side wall facing the cylinder head is substantially flat.

2. The exhaust structure of a motorcycle according to claim 1, wherein the inner sidewall of the first expansion chamber is inclined to be widened outside toward a front side, a portion of the first exhaust pipe which extends forward from the exhaust port is widened outward accordingly as it extends toward the front side along the inner sidewall, and wherein the first exhaust pipe is connected to the first expansion chamber on the right side of the down tube at a position that is lower than either the exhaust port or the third bending portion, and when the engine is viewed in a right side view, the first expansion chamber is seen to be positioned entirely below the head cover and to be mounted at an angle sloping upwardly and rearwardly from front to back thereof.

3. The exhaust structure of a motorcycle according to claim 1, wherein the second exhaust pipe extends rearwardly and substantially horizontally from the joint with the first expansion chamber, through an inner side of a pivot plate connected to a rear end of the main tube, and then continues rearwardly and substantially horizontally and is connected to the muffler which is disposed behind the pivot plate.

4. The exhaust structure of a motorcycle according to claim 1, wherein the exhaust port is open to a front side of a cylinder head behind the down tube and faces down at an angle at a right side of the main body.

5. The exhaust structure of a motorcycle according to claim 4, wherein the exhaust port is positioned higher relative to a joint of the down tube and a lower frame in the height direction of the main body and positioned in the vicinity of a middle portion in an up-down direction of the down tube.

6. The exhaust structure of a motorcycle according to claim 1, wherein the first exhaust pipe includes a first pipe, a second pipe and a third pipe, the second pipe is larger in diameter relative to the first pipe, and the third pipe is larger in diameter relative to the second pipe.

7. The exhaust structure of a motorcycle according to claim 6, wherein the diameter of the first expansion chamber is larger than the third pipe wherein exhaust gas flowing into the first expansion chamber expands and a pressure drop occurs.

8. The exhaust structure of a motorcycle according to claim 1, wherein as a diameter of the first exhaust pipe increases in stages from an upper stream to a lower stream of the exhaust structure, resistance to exhaust gas is reduced.

9. An exhaust structure adapted to be used with a motorcycle, in which a main tube is provided for extending rearwardly from a head pipe disposed at a front side of a main body, an engine is disposed under the main tube, the engine includes a cylinder extending upwardly from a crankcase, a down tube is disposed on a center line in a left-right direction of the main body, a lower frame extending downwardly from the down tube and having left and right side lower frames which are parallel to each other and which extend rearwardly under the engine, the exhaust structure comprising:

an exhaust port open at a front side of the cylinder, the exhaust port being disposed behind the down tube and being deviatingly open at the right side from the center line in the left-right direction of the main body, a first exhaust pipe connected to the exhaust port and extending downwardly and forwardly at an angle to the right side of the main body;

a first expansion chamber directly connected to a downstream end of the first exhaust pipe;

a second expansion pipe directly connected to a downstream end of the first exhaust chamber via a joint, the joint being at a position directly above a clutch storage portion protruding to the right side in the crankcase and near a lower portion of a throttle body, and a muffler having a second expansion chamber directly connected to a downstream end of the second exhaust pipe, wherein the first exhaust pipe includes at least first, second, third, fourth, and fifth bending portions, wherein the first exhaust pipe adapted to be connected to the exhaust port extends down forward of the main body, bends toward a left side of the main body at the first bending portion in front of the down tube, then extends downward toward the left side of the main body substantially horizontally across the center line in a left-right direction of the main body, the first exhaust pipe bends upwardly at an angle to the left side of the main body at the second bending portion in front of the left side lower frame at the left side of the main body, then turns in a U-shape at the third bending portion and then extends toward the right side of the main body, the first exhaust pipe bends toward the right side of the main body at the fourth bending portion in front of the lower frame at the left side of the main body and then extends substantially horizontally under the second bending portion, thereafter the first exhaust pipe bends to the right side of the main body at the fifth bending portion, and is connected to a first expansion chamber disposed at a side of the cylinder at the right side, wherein the third bending portion has a U-shape, is arranged on the left side of the main body, and opens in a forward direction that slopes downwardly and at an angle toward the right side relative to a length of the motorcycle, and portions of the first exhaust pipe extending forwardly from left and right sides of the U-shaped third bending portion are substantially parallel to each other, wherein the second exhaust pipe extends rearwardly and substantially horizontally from the joint with the first expansion chamber, through an inner side of a pivot plate connected to a rear end of the main tube, and then continues rearwardly and substantially horizontally and is connected to a second expansion chamber of a muffler which is disposed behind the pivot plate.

10. The exhaust structure of a motorcycle according to claim 9, wherein an inner sidewall of the first expansion chamber is inclined to be widened outside toward a front side, a portion of the first exhaust pipe which extends forward from the exhaust port is widened outward accordingly as it extends toward the front side along the inner sidewall, wherein the first exhaust pipe is connected to the first expansion chamber on the right side of the down tube at a position that is lower than either the exhaust port or the third bending portion, and when the engine is viewed in a right side view, the first expansion chamber is seen to be positioned below a head cover and to be mounted at an angle sloping upwardly and rearwardly from front to back thereof.

11. The exhaust structure of a motorcycle according to claim 9, wherein the second exhaust pipe is connected to a rear end of the first expansion chamber at a position directly above a clutch storage portion protruding to the right side in the crankcase, wherein when the engine is viewed in a front view, a portion of the first exhaust pipe extending between the exhaust port and the third bending portion can be seen to extend from the right side of the down tube, across a front of the down tube, and to the left side of the down tube, and a portion of the first exhaust pipe extending from the third bending portion to the first expansion chamber can be seen to extend from the left side of the down tube, across a front of the left and right side lower frames connected to a lower end of the down tube, and to the right side of the down tube, wherein the first exhaust pipe is arranged entirely above portions of the lower frames extending under the engine.

12. The exhaust structure of a motorcycle according to claim 9, wherein the exhaust port is positioned higher relative to a joint of the down tube and the lower frame in the height direction of the main body and positioned in the vicinity of a middle portion in an up-down direction of the down tube.

13. The exhaust structure of a motorcycle according to claim 9, wherein the first exhaust pipe includes a first pipe, a second pipe and a third pipe, the second pipe is larger in diameter relative to the first pipe, and the third pipe is larger in diameter relative to the second pipe.

14. The exhaust structure of a motorcycle according to claim 13, wherein the diameter of the first expansion chamber is larger than the third pipe, and wherein exhaust gas flowing into the first expansion chamber expands and a pressure drop occurs.

15. The exhaust structure of a motorcycle according to claim 9, wherein as a diameter of the first exhaust pipe increases in stages from an upper stream to a lower stream of the exhaust structure, resistance to exhaust gas is reduced.

* * * * *